United States Patent [19]

Rose et al.

[11] Patent Number: 4,505,595

[45] Date of Patent: Mar. 19, 1985

[54] DUAL TIMING EVENT STOPWATCH

[75] Inventors: Reinhold R. Rose, 10100 Oso Ave., Chatsworth, Calif. 91311; Lance J. Lieberman, Port Washington, N.Y.

[73] Assignee: Reinhold R. Rose, Chatsworth, Calif.

[21] Appl. No.: 581,254

[22] Filed: Feb. 17, 1984

[51] Int. Cl.[3] ..... G04F 8/00

[52] U.S. Cl. ..... 368/110; 368/113

[58] Field of Search ..... 368/9–12, 368/69–71, 109–113; 377/5, 20

[56] References Cited

U.S. PATENT DOCUMENTS

| | | | |
|---|---|---|---|
| 3,846,704 | 11/1974 | Bessette | 368/10 |
| 4,255,805 | 3/1981 | Jaunin | 368/108 |
| 4,456,383 | 6/1984 | Speckhart et al. | 368/10 |

*Primary Examiner*—Vit W. Miska

*Attorney, Agent, or Firm*—Hubbell, Cohen, Stiefel & Gross

[57] ABSTRACT

A dual timing event stopwatch incorporates a primary timer triggered by a remote light emission detected by an optical pick-up sensor, and a secondary timer manually triggered by a user-actuated switch. The user may select between a first operating mode wherein both timers are concurrently stopped in their interval counted cycles by a manually operated switch, and a second operating mode wherein the second timer is terminated by the manual switch and the first timer is terminated by a second remote light emission detected by the optical pick-up sensor.

14 Claims, 3 Drawing Figures

DUAL TIMING EVENT STOPWATCH

FIELD OF THE INVENTION

This invention relates generally to event timers and, more particularly, to a stopwatch for dual timing of an event based on multiple initiation and terminating signal sources or criteria.

BACKGROUND OF THE INVENTION

Demands for increased accuracy in the timing of sports events has resulted in the development of many relatively sophisticated systems for measuring an elapsed interval between initiating and terminating time points. Of course, the accuracy of any resulting measurement is firmly dependent on the ability of the system to initiate and terminate the time count at precise instants corresponding to the start and completion times of, for example, a foot race, or a skiing event, or a swim meet competition or the like. It has accordingly been commonplace for organized and officially sponsored sporting events to adopt a specific system dependent upon signal generating apparatus appropriate to the particular event or sport. In swimming and other racing sports, the automatic event time initiation signal is typically a strobe lamp flashed concurrently with the starting beeper or horn; in some cases, such a strobe may also be automatically flashed when the first swimmer to finish contacts a conventional touch plate often provided in the pool to detect such contact.

Many spectators at swim meets—and at other sporting events—have long recognized that their enjoyment in observing the races is enhanced when they themselves individually time the participants on hand-held stopwatches. A spectator may in this manner feel more like a part of the event; in addition, the use of one's own stopwatch presents an onlooker with the opportunity to obtain an elapsed time reading for a friend or relative or other particular participant irrespective of whether that individual eventually wins or places and thus receives an "official" time for the race. It is in fact a common practice at swim meets for the event officials to provide spectators with two strobe light flashes—a predetermined time interval agent—so that onlookers can verify the accuracy of their individual timing devices prior to the start of the races.

One drawback of a hand-held stopwatch—be it a standard mechanical timer or one of the readily available electronic counting and display types—is its dependence for accuracy in interval measurement on the mechanical coordination and reflexes of the user. Unless the user presses the start button or switch to initiate the measurement period at the precise moment that the race begins, the final elapsed interval measured will only approximate the actual event time. Although most users of hand-held stopwatches are cognizant that an inaccuracy of unknown magnitude physiological response time is present in the resulting measurement, few truly appreciate how great the inaccuracy can be.

OBJECTS OF THE INVENTION

It is accordingly the desideratum of the invention to provide a hand-held stopwatch actuatable by a remote light emission indicating the start of a sporting event to thereby eliminate a source of substantial inaccuracy in conventional spectator timing of such events.

It is a particular object of the invention to provide a hand-held stopwatch incorporating a first timer actuated by a remote light emission and a second timer manually actuated by the user, and wherein the timing intervals of both said timers are terminated by a common, manually operated switch to thereby enable the user to observe the difference between a measurement automatically initiated by the official strobe and a measurement manually initiated.

It is a further object of the invention to provide such a dual timing hand-held stopwatch wherein at the option of the user the termination of the timing interval of the first timer is controlled by a remote light emission rather than a manual user-operated switch.

An additional object of the invention is to provide such a hand-held dual timing event stopwatch that is relatively low in cost and which may be economically manufactured utilizing well-known techniques and readily available component parts.

Further objects, features and advantages of the present invention will be more fully appreciated by reference to the following detailed description of a presently preferred, but nonetheless illustrative, embodiment in accordance with the invention when taken in conjunction with the accompanying drawing.

BRIEF DESCRIPTION OF THE DRAWING

In the drawing, wherein similar reference characters denote similar elements throughout the several views.

DETAILED DESCRIPTION OF THE PREFERRED EMBODIMENT

Figure 1:
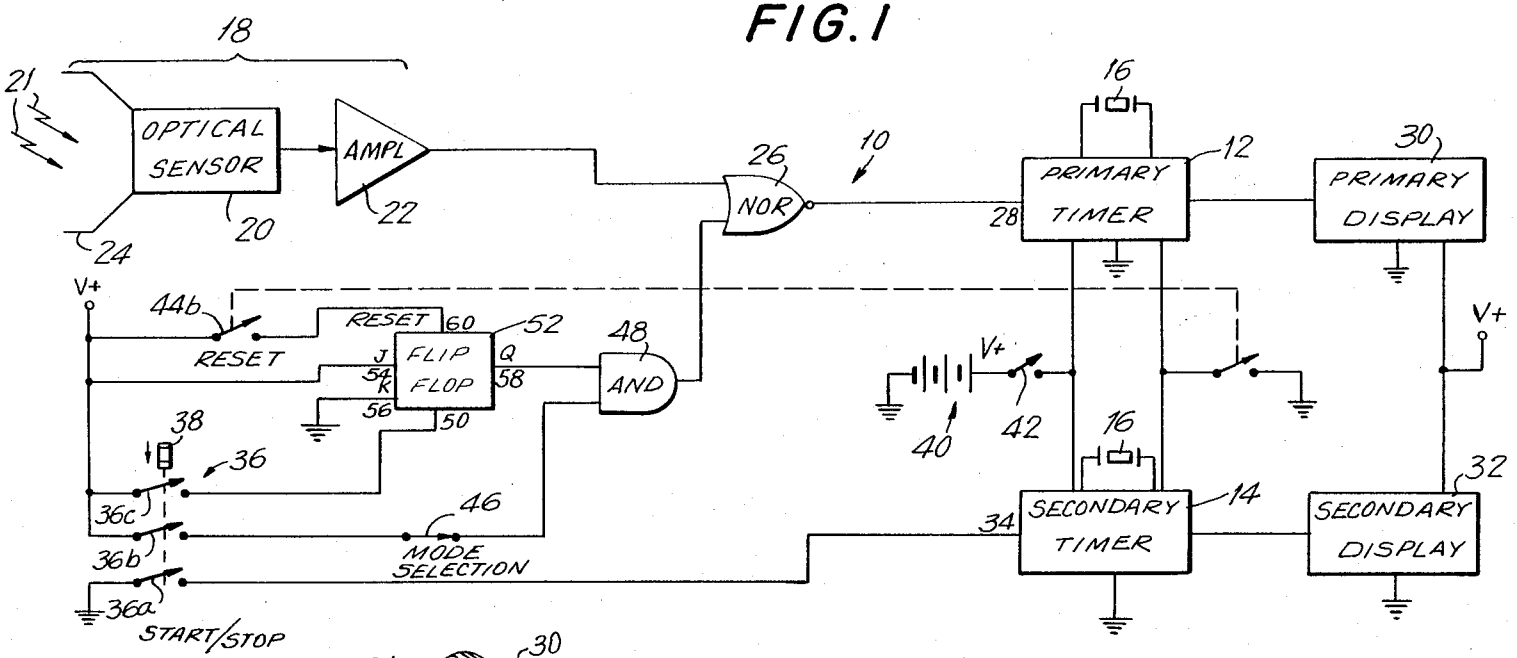
FIG. 1 is a diagrammatic illustration of an electronic circuit for a dual timing event stopwatch constructed in accordance with the present invention.
Figure 3:
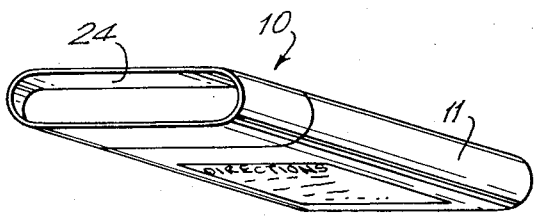
FIG. 3 is a front perspective view from the underside of the stopwatch of FIG. 2.

Turning now to the drawing, there is illustrated a dual timing event stopwatch designated by the general reference numeral 10 and constructed in accordance with the teachings of the present invention. Stopwatch 10, which may be housed in a casing 11 (FIGS. 2 and 3), includes a first or primary timer 12 and an auxiliary or secondary timer 14. Each of the timers 12, 14 is preferably a monolithically integrated circuit, such as an Intersil ICM7045 CMOS timer chip or other suitable circuit package available from a number of manufacturing sources for use in constructing a stopwatch or like timing device. If desired, both the first and second timers 12, 14 may be formed as a single integrated circuit, thereby minimizing the otherwise necessary interchip connections. It should in any event be understood that the diagrammatic circuit of FIG. 1 illustrates only those connections to timers 12, 14—and to others of the electronic components—needed to enable a skilled worker to comprehend and practice the disclosed invention; other connections as may be required in accordance with the particular components selected for manufacture are considered to be fully within the mechanical ability of one skilled in the relevant art.

In the disclosed embodiment, each timer circuit 12, 14 is of the type having a single input for receiving both the start and stop signals which initiate and terminate, respectively, the timing interval. Each timer is started—and stopped—by momentarily grounding its input or, in other words, by feeding a low logic signal level pulse to its input, and the reference timebase of each circuit 12, 14 is provided by a crystal 16 of suitable frequency. Nevertheless, substitution of a different timing circuit may require a high, rather than a low, level input for start/stop operation, or the crystal 16 may be incorporated directly into the integrated circuit package, or a timer having separate start and stop inputs may be employed. These and other like modifications are within the scope and contemplation of the inventors and the specific disclosure herein should be understood as being solely by way of example in accordance with a presently preferred embodiment of the invention.

The start or time measurement initiating signal for primary timer 12 is generated by an optical pick-up 18 comprising a sensor 20 and an amplifier 22. Sensor 20 generates a signal in response to detection of a remote light emission 21, such as that produced by a strobe lamp flashed at a swim meet to indicate the start of the race. The output of sensor 20 is directed to amplifier 22, which may comprise a simple transistor signal booster, or which might alternatively or additionally incorporate suitable wave or pulse shaping circuitry. Sensor 20 is preferably recessed within a shield or hood 24 at least partially enveloping the sensor and having an opening through which remote light emissions are received for reducing the possibility of false timer triggering by stray transient light.

The output of amplifier 22 which, for purposes of illustration, comprises a positive or high logic signal level pulse generated in response to detection of a remote strobe flash, feeds one input of a two-input NOR gate 26, the output of which is connected to the start/stop input 28 of primary timer 12. A positive pulse generated by optical pick-up 18 is accordingly converted before being directed to timer 12 into the low level signal required to initiate interval timing thereby.

The time interval measured by primary timer 12 is output for display on a liquid crystal or other suitable multi-digit display 30. A similar display 32 is connected to the output of secondary timer 14 for indicating the time measured thereby. Both the displays 30 and 32 preferably remain activated continuously to provide a running indication of the intervals being measured by timers 12, 14 once each has been triggered by an appropriate start signal.

Secondary timer 14 is triggered at its input 34 by a start/stop switch 36 momentarily actuated through the manual application of inward finger pressure to its switch pushbutton 38. Switch 36 more particularly comprises a momentary-throw, multi-pole assembly which includes a first, normally-open set contact set **36*a* connected between ground (low signal level) and input 34 of secondary timer 14. (Additional normally-open contact sets 36*b*, 36*c* are activated to close their respective circuit paths concurrently upon operation of switch 36, as will hereinafter be described.) When switch pushbutton 38 is depressed by the user, secondary timer input 34 is momentarily taken low to initiate, or terminate, a counting interval. It should accordingly be recognized that the depiction of switch 36 as a purely mechanical assembly is by way of illustration alone; switch 36 must in fact be configured to produce a bounce-free contact closure so as to concurrently pass only a single pulse at each of its three contact sets upon user depression of switch button 38**.

Operating power for primary and secondary timers 12, 14 is provided by a battery 40 connected to the timers (and, although not specifically shown, to the remainder of the operating circuit elements) through a main power switch 42. Both timers are simultaneously reset by momentary closure of normally-open contact set **44*a* of a two-pole reset switch 44 which grounds the timer reset input as is generally known and understood. Other timing features conventionally available by appropriate configuration of the timer circuit modules 12, 14—such, for example, as split, rally and sequential timing operations—may be incorporated in the inventive stopwatch 10** as desired, and such additions are deemed to be within the scope of the disclosed invention.

As previously indicated, start/stop switch 36 includes two additional normally-open contact sets **36*b*, 36*c* that, together with first contact set 36*a*, are simultaneously momentarily closed on user depression of switch pushbutton 38 to complete their independent circuit paths. Switched contacts 36*b* are connected between the positive or high signal level terminal of battery 40, designated V+, and one contact of a mode selection switch 46. Switch 46 is of the single-pole, single-throw type and may for example comprise a slide such as that depicted in FIG. 2 wherein the switch is shown in its closed condition or first operating mode corresponding to its illustrated state in FIG. 1. The other contact of mode selection switch 46 is connected to one input of a two-input AND gate 48, the output of which feeds the second input of NOR gate 26. Any conventionally available integrated circuits compatible with timers 12, 14 may be utilized in implementing NOR gate 26, AND gate 48, and amplifier 22** or, in the alternative, discrete components may be interconnected to form suitable logic elements.

The third set of contacts **36*c* of start/stop switch 36 is connected between the positive or high signal level (V+) terminal of battery 40 and the clock input 50 of a JK Flip-Flop 52. The J input 54 of Flip-Flop 52 is connected to the high signal level (V+) terminal of battery supply 40, and its K input 56 is connected to ground, thereby so conditioning the Flip-Flop that its Q output 58 can go to or stay at high signal level (logic 1) but cannot return to ground or low signal level (logic 0). In response to a positive or high signal level pulse input to clock input 50 of Flip-Flop 52, its Q output 58 is driven high. JK Flip-Flop 52 may comprise any available integrated or discrete-component circuit suitable and compatible for use with timers 12, 14. It is however preferred that the Flip-Flop be negative-edge triggered so as to assure that effective changes in its Q output 58 take place subsequent to the termination of each closure of start/stop switch 36. It should nevertheless be obvious that the disclosed circuit arrangement could be readily modified to operatively incorporate a Flip-Flop having different edge or level triggering characteristics or the like or, in fact, other circuit components—such as a latch, or a combination of logic gates, or an electromechanical relay—could alternatively be employed for performing the function of Flip-Flop 52**.

The Q output 58 of Flip-Flop 52 is connected to the second input of AND gate 48 so that, when start/stop switch 36 is activated by the user of stopwatch 10 with switch 46 closed and Flip-Flop Q output 58 high, AND gate 48 outputs a positive or high level signal to NOR gate 26 which, in turn, outputs a low level activating signal to input 28 of primary timer 12. When switch 36 is activated while either switch 46 is open or Flip-Flop Q output 58 is at low signal level, on the other hand, the output of AND gate 48 remains at low signal level, which is converted to high signal level in NOR gate 26, and input to timer 12; timer 12 is thus unaffected under these circumstances by user depression of start/stop switch pushbutton 38.

A second set of normally-open, concurrently switched contact 44*b* of momentary reset switch 44 is connected between the positive or high signal level ($V^+$) terminal of battery 40 and the reset input 60 of Flip-Flop 52. When the reset input 60 of Flip-Flop 52 is driven high—by momentary closure of reset switch contacts 44*b*—the Q output 58 of the Flip-Flop is driven to low signal level, and another output conventionally designated $\overline{Q}$ (to which no connection is made and which is accordingly not illustrated in the drawing) is driven high. Thus, each time that stopwatch 10 is reset by user depression of the reset switch pushbutton, the Q output 58 of Flip-Flop 52 is placed at low signal level and the next subsequent activation of start/stop switch 36 will have no effect on primary timer 12. Since Q output 58 is driven high by the first closure of start/stop switch 36, however, each subsequent closure of switch 36 after the first—assuming mode selection switch 46 to be in its closed or first operating mode condition—will be received as a valid low level start/stop timing signal at input 28 of primary timer 12. The combination of mode selection switch 46, AND gate 48 and Flip-Flop 52 accordingly functions as an automatic pulse routing system by which timer trigger signals generated by activations of start/stop switch 36 are either blocked from reaching, or passed through to, the input 28 of primary timer 12—depending of course on the position or state of mode selection switch 46 and whether the activation of start/stop switch 36 is the first, or a subsequent, activation following a reset or initial power-up of the timer.

In use, a spectator at, for example, a swim race points the forward or shield (24) bearing end of stopwatch 10 in the direction of the strobe light which will flash to signal the start of the race. Momentary illumination of the remote strobe is detected by sensor 20 which, in conjunction with amplifier 22, generates a high signal level pulse that is converted in NOR gate 26 to a low level signal suitable to initiate the timing cycle of primary timer 12. At the same time, the user may depress switch button 38 to thereby manually trigger secondary timer 14 for providing a parallel elapsed time measurement. Assuming for the moment that mode selection switch 46 is disposed in its first, closed position illustrated in FIGS. 1 and 2, subsequent user depression of switch button 38 a second time—at the conclusion of the event—terminates the timing interval of both timers 12, 14 and causes each to display its respective time measurement on the associated display 32, 34. The user can then readily compare the two displays and determine the accuracy with which the initial manual start of secondary timer 14 was accomplished. Thus, the closed condition or state of switch 46 corresponds to a first operating mode in which primary timer 12 is started by an optically-detected flash, secondary timer 14 is started by a first manual actuation of start/stop switch 36, and both timers are simultaneously stopped by a second manual actuation of switch 36.

It should be recognized that even where manual actuation of start/stop switch 36 to initiate operation of secondary timer 14 takes place subsequent to optical remote flash detection and the consequent start of primary timer 12—i.e. either as a result of unintended reflexive delay or by design—the first closure of switch 36 cannot improperly be received by primary timer input 28 which, since already in operation, would otherwise be stopped by such receipt. The inclusion of Flip-Flop 52 assures that, following a reset of stopwatch 10 by closure of reset switch 44 (or when operating power is initially applied to stopwatch 10 through on-off switch 42), the first closure of start/stop switch 36 is not applied to primary timer 12 because the initially low signal level at the Q output 54 in effect blocks or closes AND gate 48. Thus only secondary timer 14 receives an operating input signal pulse on this first closure of switch 36. On subsequent activations of switch 36, on the other hand, the Flip-Flop Q output 58 is at high signal level so that, with mode selection switch 46 closed (corresponding to the mode labelled "optical start" in FIG. 2), an operating or start/stop signal is applied to primary timer input 28 as well as to secondary timer input 34.

Figure 2:
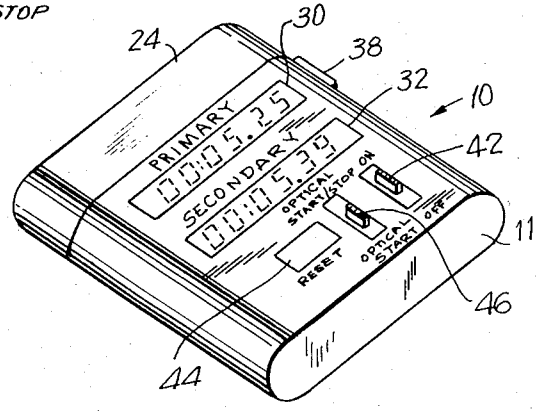
FIG. 2 is an elevated rear perspective view of a dual timing event stopwatch in accordance with the invention.

Stopwatch 10 is further operable in a second operating mode (corresponding to the "optical start/stop" mode switch label in FIG. 2) wherein mode selection switch 46 is in its open state or condition to break or open the circuit path between start/stop switch contacts 36*b* and AND gate 48. As should be evident, with mode switch 46 thus open, AND gate 48 is effectively disabled so that its output remains at low signal level irrespective of the state of start/stop switch 36. In this second operating mode the only signals input to NOR gate 26 capable of generating the low level signal required to operate primary timer 12 are those received from optical pick-up 18; put another way, the operation of primary timer 12 is both started and stopped by strobe light flashes detected by optical pick-up assembly 18. Secondary timer 14, on the other hand, is independently operable with respect to both initiation and termination of the timing interval by manual activation of start/stop switch 36.

The inventive dual timing event stopwatch readily lends itself to numerous advantageous uses in the setting of a sporting event. For example, with switch 46 closed to effect first mode operation, the user need not depress switch pushbutton 38 to start secondary timer 14 concurrent with the optically-effected start of primary timer 12. Secondary timer 14 might instead be utilized to separately time a portion of the overall event that begins later than the initial start—as for example where a particular individual to be timed is unintentionally delayed in starting or is participating in a second or subsequent lap of a multi-lap race. With switch 46 open for second mode operation of stopwatch 10, timers 12 and 14 essentially operate independently whereby the overall race can be automatically timed by primary timer 12 while a particular individual's performance is manually recorded by secondary timer 14.

The diagrammatic circuit of FIG. 1 is not intended to include every circuit path and component connection that may be necessary to construct a commercial embodiment of the inventive stopwatch 10 but, rather, to disclose the fundamental interrelation of elements and their functions by which the present invention is defined. Nevertheless, such additions or modifications as may be appropriate to manufacture of stopwatch 10 are considered to be fully within the mere mechanical abilities of a skilled art worker and therefore unnecessary to the within disclosure. For example, good engineering practice in utilizing CMOS integrated circuits teaches that all unused circuit inputs be connected to $V^+$ or ground; thus, each portion or pole of switches 36, 44 and 46 might in practice be constituted as a double-throw switch so that, in the open circuit condition illustrated in FIG. 1, a signal opposite to that passed with the switch closed is input to the following or upstream circuit. Similarly, although no operating power connections to amplifier 22, NOR gate 26, AND gate 48 and Flip-Flop 52 are shown in FIG. 1, it is expected that all such required connections would be incorporated in the manufacture of a stopwatch 10 constructed in accordance with the teachings of the invention. These and other such matters are left to the exercise of conventional mechanical skill.

It is further expected that, with knowledge of the foregoing disclosure, numerous additional uses and applications will be readily apparent to those skilled in the art in connection with both sporting and non-sporting timing applications.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A dual timing event stopwatch, comprising:

first timing means for measuring elapsed time between an applied start signal initiating said measurement and a subsequently applied stop signal terminating said elapsed time measurement;

first display means associated with said first timing means for displaying said elapsed time measured between said start and stop signals;

second timing means for measuring elapsed time between an applied start signal initiating said measurement and a subsequently applied stop signal terminating said measurement;

second display means associated with said second timing means for displaying said elapsed time measured thereby;

optical pick-up means for detecting a remote light emission and for generating a signal in response thereto, said optical means being connected to said first timing means for initiating said elapsed time measurement;

switch means connected to said second timing means for providing thereto a measurement initiating start signal on a first actuation of said switch means and a measurement terminating stop signal on a second actuation thereof; and mode selection means associated with said first timing means and operable for user selection between a first operating mode wherein the stop signal for terminating elapsed time measurement by said first timing means is provided on said second actuation of said switch means, and a second operating mode wherein the stop signal for terminating measurement by the first timing means is provided by said optical pick-up means in response to a remote light emission.

2. A dual timing event stopwatch in accordance with claim 1, wherein said switch means is manually actuatable by a user.

3. A dual timing event stopwatch in accordance with claim 2, wherein said switch means is momentarily actuatable.

4. A dual timing event stopwatch in accordance with claim 1 and further comprising reset means connected to said first and second timing means for preparing the same for a subsequent elapsed time measurement.

5. A dual timing event stopwatch in accordance with claim 1, wherein said optical pick-up means comprises an optical sensor and means for amplifying a signal generated by said sensor in response to a remote light emission.

6. A dual timing event stopwatch in accordance with claim 5, said optical pick-up means further comprising a shield at least partially enveloping said sensor and including an opening through which a remote light emission is directed to said sensor.

7. A dual timing event stopwatch, comprising:

first and second timing means each triggerable at an input thereof for initiating and terminating measurement of an elapsed time interval;

first and second display means, each associated with a respective one of said timing means for indicating the elapsed time interval measured thereby;

optical pick-up means for detecting a remote light emission and for generating a trigger signal in response thereto, and connected to the input of said first timing means;

start/stop switch means manually actuatable for generating a trigger signal and connected to said first and second timing means; and mode selection means for user selection between a first operating mode wherein first timing means measurement is initiated by a trigger signal generated by said optical pick-up means, second timing means measurement is initiated by a first trigger signal generating actuation of said start/stop switch means, and both said timing means interval measurements are terminated by a second actuation of said start/stop switch means, and a second operating mode wherein first timing means measurement is both initiated and terminated by trigger signals generated by said optical pick-up means in response to the detection of remote light emissions, and second timing means interval measurement is both initiated and terminated by sequential trigger signal generating actuations of said start/stop switch means.

8. A dual timing event stopwatch in accordance with claim 7, said mode selection means comprising routing means for preventing receipt at the input of said first timing means of a trigger signal generated by a first actuation of said start/stop switch means in both said operating modes, for passing to said first timing means input a trigger signal generated by a second actuation of said start/stop switch means in said first operating mode, and for preventing receipt at the input of said first timing mens of a trigger signal generated by a second actuation of said start/stop switch means in said second operating mode.

9. A dual timing event stopwatch in accordance with claim 8, said routing means comprising a manually operated mode switch for user selection between said first and second operating modes, and electronic circuit means for effecting automatic routing of trigger signals generated by actuations of said start/stop switch at least partly in accordance with the status of said mode switch.

10. A dual timing event stopwatch in accordance with claim 9, said electronic circuit means including two-state means maintained in a first operating state for a first trigger signal generating actuation of said start/-stop switch means and a second operating state for a second actuation of said start/stop switch means.

11. A dual timing event stopwatch in accordance with claim 10, said electronic circuit means further including logic gate means connected to said mode switch and said two-state means for blocking receipt by said first timing means of a trigger signal generated on a first actuation of said start/stop switch means in both said operating modes and on a second actuation of said start/stop switch means in said second operating mode, and for passing to said first timing means a trigger signal generated by a second actuation of said start/stop switch means in said first operating mode.

12. A dual timing event stopwatch in accordance with claim 11, said two-state means comprising a bistable flip-flop.

13. A dual timing event stopwatch in accordance with claim 11, said two-state means comprising a bistable JK flip-flop conditioned to permit a change from its first to its second operating state and to prevent a subsequent return to its first state unless a trigger signal is applied to a reset input of said flip-flop to return it to its first state prior to initiating a new interval timing measurement.

14. A dual timing event stopwatch in accordance with claim 11, said logic gate means comprising an AND gate.

* * * * *